US005109039A

United States Patent [19]

Eisner

[11] Patent Number: 5,109,039

[45] Date of Patent: Apr. 28, 1992

[54] MATERIAL FOR THE INSTALLATION OF RAILS

[76] Inventor: Lothar Eisner, Franz-Hornstr. 6, D-8700 Würzburg, Fed. Rep. of Germany

[21] Appl. No.: 125,773

[22] PCT Filed: Oct. 23, 1985

[86] PCT No.: PCT/DE85/00409

§ 371 Date: Jun. 25, 1986

§ 102(e) Date: Jun. 25, 1986

[87] PCT Pub. No.: WO86/02678

PCT Pub. Date: May 9, 1986

Related U.S. Application Data

[63] Continuation of Ser. No. 887,405, Jun. 25, 1986, abandoned.

[30] Foreign Application Priority Data

Oct. 26, 1984 [DE] Fed. Rep. of Germany ..... 3439252

[51] Int. Cl.[5] ..... C08J 9/32

[52] U.S. Cl. ..... 523/218; 428/307.3; 524/445

[58] Field of Search ..... 524/445; 523/218; 428/307.3

[56] References Cited

U.S. PATENT DOCUMENTS

| | | | |
|---|---|---|---|
| 4,086,098 | 4/1978 | Ruyet et al. | 523/219 |
| 4,292,214 | 9/1981 | Blount | 523/400 |
| 4,492,728 | 1/1985 | Zurkinden | 428/247 |

FOREIGN PATENT DOCUMENTS

| | | |
|---|---|---|
| 356162 | 9/1979 | Austria . |
| 636589 | 9/1936 | Fed. Rep. of Germany . |
| 815046 | 9/1951 | Fed. Rep. of Germany . |
| 1809955 | 3/1970 | Fed. Rep. of Germany . |
| 2125747 | 9/1972 | France . |
| 498979 | 9/1960 | Switzerland . |

*Primary Examiner*—Paul R. Michl
*Assistant Examiner*—Edward J. Cain

[57] ABSTRACT

A material for the installation of rails used for rail-mounted vehicles is described. The material is composed of a solvent-free, elastically curing two-component system based on polyurethane and granules of expanded clay. On curing there is provided a composite of a tough, elastic polyurethane based synthetic matrix and expanded clay granules.

2 Claims, 1 Drawing Sheet

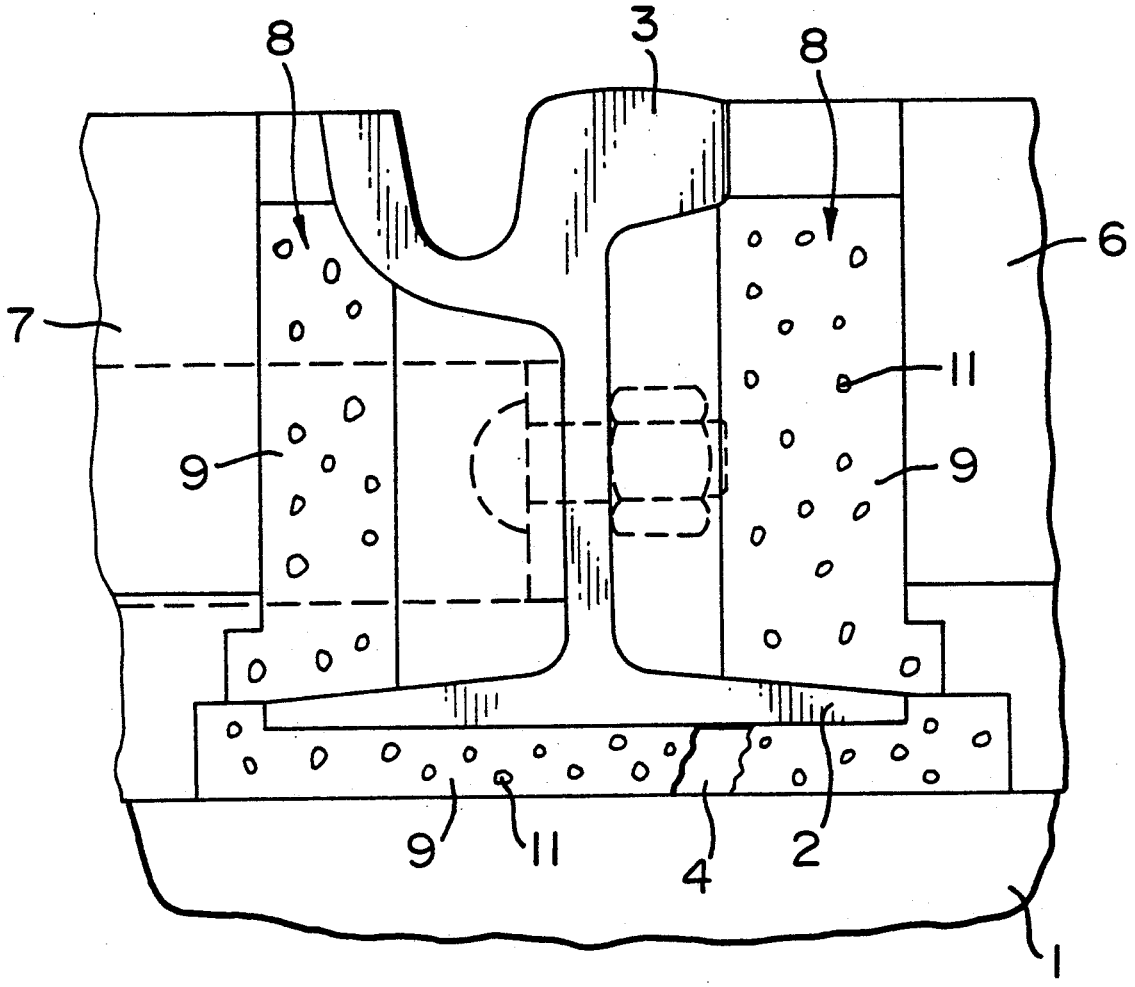
8
3
8
6
7
11
9
9
9
11
4
2
1

MATERIAL FOR THE INSTALLATION OF RAILS

This application is a continuation of application Ser. No. 06/887,405, filed Jun. 25, 1986, now abandoned.

FIELD OF THE INVENTION

The invention relates to a material for the installation of rails used for rail-mounted vehicles where the material is introduced between a conventional foundation and/or adjacent pavement and a rail.

DESCRIPTION OF THE PRIOR ART

Embedded tram rails are known, for example, from the German patent 6 36 589. Here, elastic layers of varying elasticity are provided between an underbedding and a rail base. Sand, cement and gravel are provided as additional material for the elastic material. The same elastic material was suggested to insulate the rail laterally against the adjoining joining pavement with regard to vibration and thus to noise emission.

From the DE-PS 8 15 046 a method for the installation of a tram rail and an installed tram rail are made known, in which an intermediate layer of so-called plastic concrete is applied between the rail base and the foundation. This plastic concrete is composed of bituminous binding agents of higher viscosity and mineral masses composed of grit, sand and fillers.

More recently a solvent-free, elastically curing two-component system based on polyurethane to which sand is added is used for the manufacture of elastic underlays with oscillation damping characteristics.

In order to achieve a further reduction of the constant velocity levels during tram operation,—which express themselves in air borne sound levels inside buildings—, the tram rails can be secured to spring supported concrete plates. Also a screening of the building by means of so-called earth slits is possible. For this, double slitted walls are arranged at a distance from a building to be protected, whereby the intermediate space must be filled up with a soft material. For this the double slitted walls must extend several meters under the bottom edge of the foundation. Further, a precaution for damping of the constant velocity level has become known in which the whole region of the building to be protected is encased below the earth surface with a soft outer skin.

With the costly and large-scale precautions just described, noise level reductions of between 7 and 10 db can be achieved.

SUMMARY OF THE INVENTION

It is an object of the invention to create a material for the installation of rails used for rail-mounted vehicles with which it is possible to achieve a reduction in the transfer of mechanical vibration which emanates from the rail-mounted vehicles, and thus to reduce the disturbence level.

This object is obtained by utilizing a material which is composed of a solvent-free, elastically curing two-component system based on polyurethane and granules of expanded clay. On curing, the material forms a composite consisting essentially of a tough, elastic polyurethane based synthetic matrix and expanded clay granules.

The advantages to be achieved by the invention lie particularly in that, in a simple way, a further reduction of the transfer of vibration emissions which emanate from rail-mounted vehicles is achieved as against the prior art. The material cost expenditure is hereby reduced.

The destruction susceptibility of the insulation material during repair welding of the rails is largely avoided. The expenditure for the reduction of vibration emission, e.g. in buildings, in the ground, can be considerably reduced and/or be totally omitted.

BRIEF DESCRIPTION OF THE DRAWINGS

FIG. 1 is a side elevation view partly in cross section of a rail used for rail-mounted vehicles mounted in a foundation employing the rail installation material of the present invention.

DETAILED DESCRIPTION OF THE PREFERRED EMBODIMENT

Between a concrete bed 1 and a base 2, for example, of a tram rail 3, an intermediate space 4 is set in the known manner. To the left and right of the rail 3 and at a distance and parallel to the rail 3, vertical, removable casings 6, 7 are mounted on the concrete bed 1.

Into the intermediate spaces between base 2 and concrete bed 1 and between casings 6, 7 and the rail 3, a material is poured. This material consists of a mixture of preferably a matrix material 8 formed from a solvent-free, elastically curing two-component system based on polyurethane, e.g., ICOSIT and enclosed granules 11. The granules 11 are preferably composed of fired clay and display a plurality of in themselves closed smallest air cells (inflated clay) in the inside. The outer skin of these granules 11 is sintered. The coarseness of the granules 11 may display a wide range, for example, from 1 mm to 20 mm. The mix ratio (volume ratio) of matrix to granules 11 amounts to, for example, 4:1.

The invention is, however, not restricted to the application of matrix formed from a solvent-free elastically curing two-component system based on polyurethane and expanded clay granules. Moreover, other elastomeric materials and granules of other materials with a plurality of closed cells are also suitable.

I claim:

1. Vibration damping composite for use in conjunction with rails for rail borne vehicles wherein said composite is introduced between a conventional foundation and/or adjacent pavement and a rail, characterized in that said composite consists of tough, elastic polyurethane based synthetic matrix and expanded clay granules whereby said composite reduces mechanical vibrations transmitted by a rail mounted vehicle through said rail.

2. Material for the installation of rails for rail-borne vehicles for introduction between a conventional foundation and/or adjacent pavement and the rail which consists of an admixture of elastically curing two-component polyurethane based synthetic matrix and expanded clay granules.

* * * * *